US006121855A

United States Patent [19]

Hiratsuka et al.

[11] Patent Number: 6,121,855

[45] Date of Patent: Sep. 19, 2000

[54] DIELECTRIC FILTER COMPRISING AT LEAST ONE COUPLING MEMBER COUPLED TO TWO COUPLING MODES OF A RESONATOR AND A COMMUNICATION DEVICE USING THE SAME

[75] Inventors: Toshiro Hiratsuka, Kusatsu; Tomiya Sonoda, Muko; Shigeyuki Mikami; Kenichi Iio, both of Nagaokakyo, all of Japan

[73] Assignee: Murata Manufacturing Co., Ltd., Japan

[21] Appl. No.: 09/047,667

[22] Filed: Mar. 25, 1998

[30] Foreign Application Priority Data

Mar. 26, 1997 [JP] Japan ..... 9-073249
Mar. 11, 1998 [JP] Japan ..... 10-059606

[51] Int. Cl.[7] ..... H01P 1/20; H01P 1/213; H01P 7/10

[52] U.S. Cl. ..... 333/134; 333/202; 333/219.1

[58] Field of Search ..... 333/202, 204, 333/219, 219.1, 230, 134

[56] References Cited

U.S. PATENT DOCUMENTS 4,319,208 3/1982 De Bayser et al. ..... 333/204
5,461,352 10/1995 Noguchi et al. ..... 333/204

FOREIGN PATENT DOCUMENTS

734088 A1 9/1996 European Pat. Off. ..... 333/219.1
62-160801 7/1987 Japan ..... 333/205
2-16801 1/1990 Japan ..... 333/202

*Primary Examiner*—Robert Pascal
*Assistant Examiner*—Barbara Summons
*Attorney, Agent, or Firm*—Ostrolenk, Faber, Gerb & Soffen, LLP

[57] ABSTRACT

A dielectric filter is formed by electrode non-formation parts (openings) disposed on opposite main surfaces of a dielectric plate so as to form a dielectric resonator, as well as two coupling members coupled to said dielectric resonator. A large amount of attenuation required for blocking a certain frequency is secured by generating an attenuation pole in the area of that frequency. The two coupling members may be constituted by probes or other structures. The two coupling members are non-parallel to each other, and one of the coupling members is coupled with at least two coupling modes of the resonator.

12 Claims, 13 Drawing Sheets

TE010 MODE

HE210 MODE

HE210 RESPONSE

TE010 RESPONSE

SYNTHESIZED RESPONSE

DIELECTRIC FILTER COMPRISING AT LEAST ONE COUPLING MEMBER COUPLED TO TWO COUPLING MODES OF A RESONATOR AND A COMMUNICATION DEVICE USING THE SAME

BACKGROUND OF THE INVENTION

1. Field of the Invention

The present invention relates to a dielectric filter and, a transmitter-receiver antenna sharing device (duplexer) and a microwave band and/or milliwave band communication device using same.

2. Description of the Related Art

Recently, communication systems with large capacity and high speed transmission are being required corresponding to a rapid increase in the demand for mobile communications, including multimedia. Accompanying this expansion of the required information-carrying capacity, the frequency band used is being raised from the microwave band to the milliwave (millimeter-wave) band. Even in such milliwave band, the TE01 delta mode dielectric resonator which has been conventionally used in the microwave band can be similarly used, but a resonance frequency thereof is determined by a dimension of a cylindrical shaped dielectric, and for example, at 60 GHz, since it will be very small as a height thereof being 0.37 mm, and a diameter thereof being 1.6 mm, a severe manufacturing precision is required. Further in case of constituting a filter using the TE01 delta mode dielectric resonator, it is required to place a plurality of the TE01 delta mode dielectric resonators in a predetermined space with a high positioning precision, and a further problem is that the structures for trimming the amount of a resonance frequency for each resonator and for trimming coupling between the dielectric resonators are complex.

Accordingly, the applicant of the present application has proposed the dielectric resonator and the band-pass filter by which these problems were solved, in the Japanese Patent Application No. 7-62625 (EP 0 734 088 A1.

Now, in this resonator and the corresponding filter, electrode non-formation parts on the dielectric plate are configured to form dielectric resonators. Electrodes are formed on both main surfaces of such dielectric plate and openings, i.e., electrode non-formation parts, are formed in the respective electrodes at positions opposite to each other. Only one resonance mode of the dielectric resonators is used, by drawing a coupling member to be coupled to the dielectric resonators near the dielectric resonators, as well as, by placing a coupling member used for an input and a coupling member used for an output on a straight line, or in parallel, with respect to the dielectric resonators.

However, in a blocking region attenuation characteristic, when a large attenuation quantity is necessary for a certain frequency, the requirement may not be satisfied by the conventional structured dielectric filter as described above. In particular, in interstage filter, an oscillation frequency of a local oscillator and an attenuation quantity at an image frequency present problems. Further, in an antenna common use device, the attenuation at receiving frequencies in a transmitting side filter, and the attenuation at transmitting frequencies in a receiving side filter present problems, respectively.

SUMMARY OF THE INVENTION

Accordingly it is an object of the present invention to provide, in a dielectric filter constituting, as a dielectric resonator, electrode non-formation parts opposite each other on both main surfaces of a dielectric plate, as well as providing two coupling members coupled to the dielectric resonator, a dielectric filter adapted to secure a large attenuation quantity required for a certain frequency in a blocking area, by generating an attenuation pole in a predetermined frequency area.

It is another object of the present invention to provide a transmitter-receiver common use device constituted of a filter which can obtain a predetermined large attenuation characteristic, and to provide a communication device utilizing the transmitter-receiver common use device.

The present invention is a dielectric filter, formed by:

forming an electrode on a first main surface with a portion thereof being an electrode non-formation part;

forming an electrode on a second main surface with a portion opposite to the electrode non-formation part of the first main surface being an electrode non-formation part;

whereby the electrode non-formation parts on the dielectric plates constitute a dielectric resonator; and providing two coupling members coupled to the dielectric resonator, causing an attenuation pole to occur for securing a large attenuation quantity at a predetermined frequency.

For that purpose, two coupling members are placed in non-parallel fashion.

By placing two coupling members in a non-parallel fashion such as described above, two coupling members couple to a plurality of resonance modes of the dielectric resonator, and an attenuation pole is occurs by a combination of responses for these resonance modes, thereby it provides a large attenuation quantity nearby the attenuation pole.

In case of configuring the coupling members by the probes, by making a shape as a predetermined position thereof being bent, the angle formed by two coupling members is set.

Herein, a configurational example of the above mentioned dielectric filter will be described with reference to FIGS. 1 to 4.

FIG. 1 is a plane view of the main parts of the dielectric filter. An electrode 1 is formed on a upper surface of a dielectric plate 3 and one portion thereof is an electrode non-formation part (opening) 4, and an electrode 2 (see FIG. 2) is formed on a lower surface of the dielectric plate 3 and one portion thereof is an electrode non-formation part (opening). According to this, a dielectric resonator is constituted by the respective openings on opposite side of the dielectric plate 3. Numerals 6, 7 are probes which constitute coupling members, respectively, and an angle theta formed by the portions of the probes 6,7 nearby the dielectric resonator, is set at a predetermined value.

FIG. 2 is a diagram showing a coupling relation in two resonance modes of the dielectric resonator and the probe 7, (A)and (B) are a plane view and a cross-sectional view, respectively, for the $TE_{010}$ mode, (C) and (D) are a plane view and a cross-sectional view, respectively, in the $HE_{210}$ mode. As shown in (B) and (D), by providing the electrodes 1, 2 to the dielectric plate 3, with the openings 4,5 being on opposite sides of the dielectric plate 3, a dielectric resonator is constituted by these openings In FIG. 2, the arrows with solid lines indicate the electric field distributions, and the arrows with dotted lines and the loops with dotted lines indicate the magnetic field distributions, respectively. As shown in (A) and (B), since the electric field is distributed in a rotational direction of which a center of the dielectric resonator is as an axis in the $TE_{010}$ mode, it will equally couple no matter in which direction the probe 7 approaches with respect to this dielectric resonator. Further, as shown in (C) and (D), in case of the $HE_{210}$ mode, since the distributions of the electric field and the magnetic field are each rotationally symmetrical and arc set apart form each other by 90 degrees, a coupling degree with the $HE_{210}$ mode changes according to a direction of the probe 7 with respect to these electromagnetic field distributions. In the state shown in FIG. 2, it will couple to the $HE_{210}$ mode the most strongly.

FIG. 3 shows examples of a response for two resonance modes mentioned above and of a response which can be obtained by properly defining an angle which is formed by two probes as shown in FIG. 1. In the figure, the abscissa represents the frequency, and the ordinate represents the attenuation quantity and the phase, the attenuation characteristic is shown in a solid line, and the phase characteristic is shown in a dotted line. In a case that the dimensions of the dielectric resonators are identical, as is obvious from the electromagnetic field distributions shown in FIG. 2, a central frequency f1 of a pass band of the $HE_{210}$ mode will appear on a lower side of a central frequency f2 of a pass band of the $TE_{010}$ mode. By setting the angle theta formed by the probes 6 and 7 in a range of 0 degree<theta=90 degrees as shown in FIG. 1, because the dielectric resonators together couple to two modes of the $HE_{210}$ mode and the $TE_{010}$ mode with respect to the probe 6 or the probe 7, the characteristic between the probes 6–7 turns out to be a characteristic in which the responses of the $HE_{210}$ mode and the $TE_{010}$ mode are combined, as shown in FIG. 3(C). As a result, a characteristic is obtained in of which a frequency f between f1 and f2 is made an attenuation pole.

Although the $TE_{010}$ mode and the $HE_{210}$ mode are shown in the above mentioned examples, it is similar to a case of using the $TE_{010}$ mode and the $HE_{310}$ mode 1 besides them, and the invention of the present application can be applied generally to providing the coupling members respectively coupled to a plurality of modes for which the electromagnetic fields have different distributions in a rotational direction with as an axis thereof being a center of the dielectric resonator.

FIG. 4 shows an attenuation characteristic in which the angle theta formed by the probes 6, 7 has been changed three different ways. Herein, the theta 1 is 50 degrees, the theta 2 is 40 degrees, and the theta 3 is 30 degrees. By measuring the attenuation characteristic over a wider range than the usage frequency band, in this example a response of the $TE_{010}$ mode appears at about 35.1 GHz, a response of the $HE_{210}$ mode appears at about 31.2 GHz, and a response of the $HE_{310}$ appears at about 38.5 GHz. Then, an attenuation pole is occurred between a pass band of the $TE_{010}$ mode and a pass band of the $HE_{210}$ mode, or between a pass band of the $TE_{010}$ mode and a pass band of the $HE_{310}$ mode, and a frequency of its attenuation pole changes, by changing the angle theta. The attenuation is shifted by the theta such as described above, because that according to the angle formed by the coupling members for the electromagnetic field distributions of two or more resonance modes, a coupling ratio of the coupling members and each resonance mode changes, and thus the characteristics of an insertion loss and a phase of each resonance mode change.

A dielectric filter for largely attenuating in a predetermined frequency band could be obtained by utilizing the above described actions.

Besides the probe, a microstrip line, a coplanar guide, a stripline, a dielectric line, a wave guide, or a slot line can be used as the coupling member described above.

Further, the present invention constitutes a transmitter-receiver common use device, by using the dielectric filter mentioned above as a transmitting filter and a receiving filter, and providing the transmitting filter between a transmitting signal input port and an input/output port, and providing the receiving filter between a receiving signal output port and the input/output port. Moreover, a communication device is constituted by connecting a transmitter circuit to the transmitting signal input port of the transmitter-receiver common use device, and connecting a receiver circuit to the receiving signal output port of the transmitter-receiver common use device, and connecting an antenna to the input/output port of the transmitter-receiver common use device.

DESCRIPTION OF THE PREFERRED EMBODIMENTS

A configuration of a dielectric filter according to a first embodiment will be described with reference to FIGS. 5–7.

Figure 1:
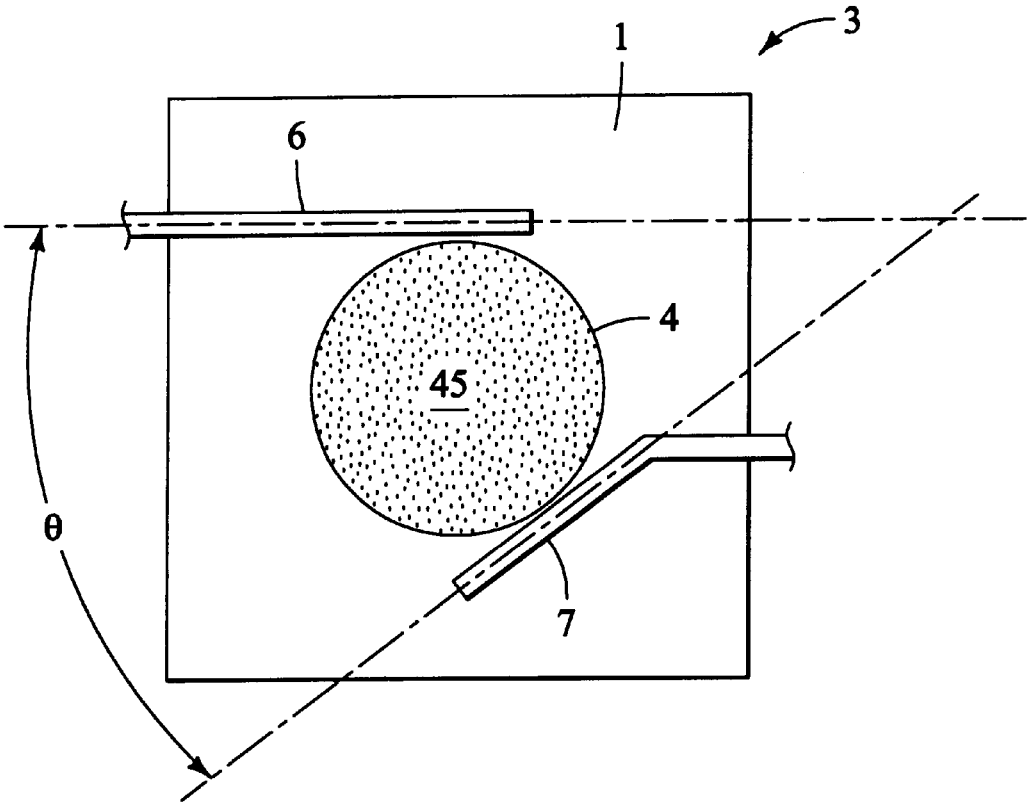
FIG. 1 is a plane view showing a configurational example of a dielectric filter.
Figure 2:
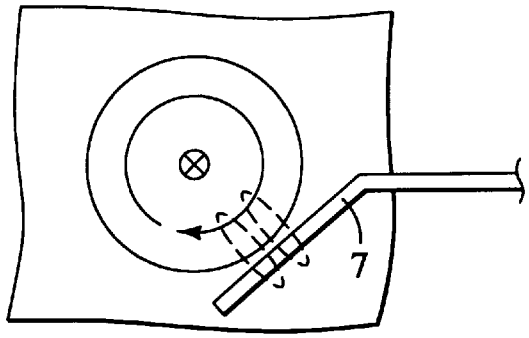
FIG. 2A to 2D are diagrams showing coupling states with coupling members for two resonance modes.
Figure 2:
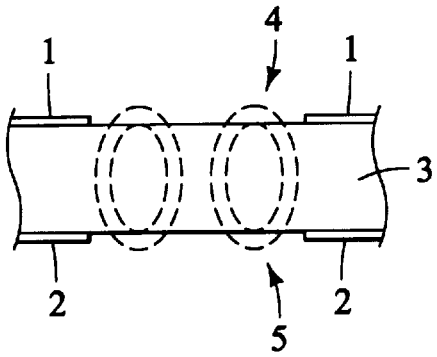
Figure 2:
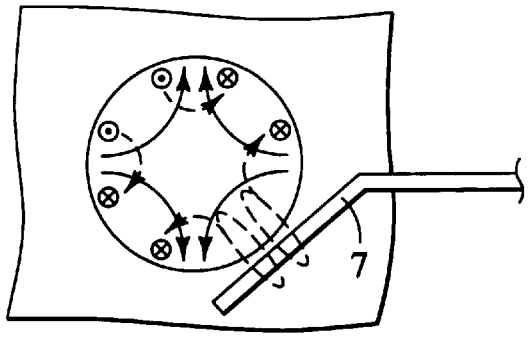
Figure 2:
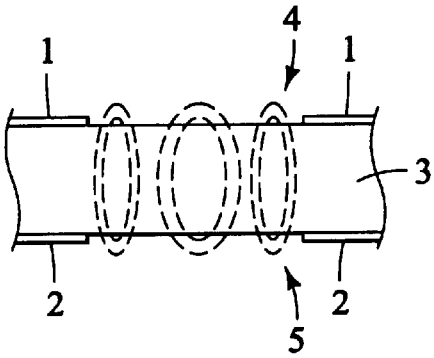
Figure 3:
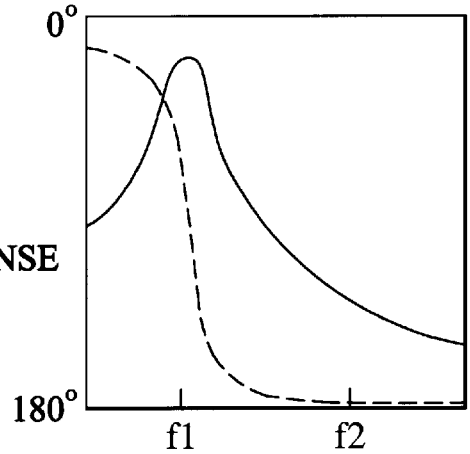
FIG. 3A to 3C are diagrams showing responses for two resonance modes and a response of which both modes are combined.
Figure 3:
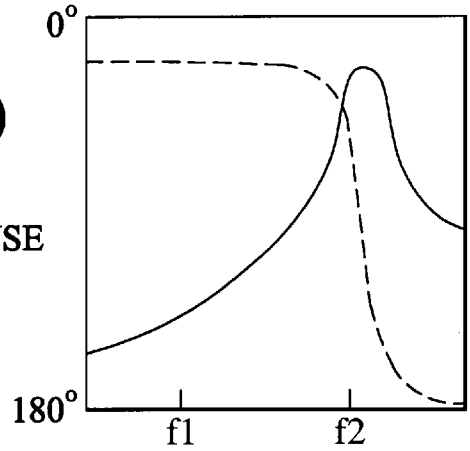
Figure 3:
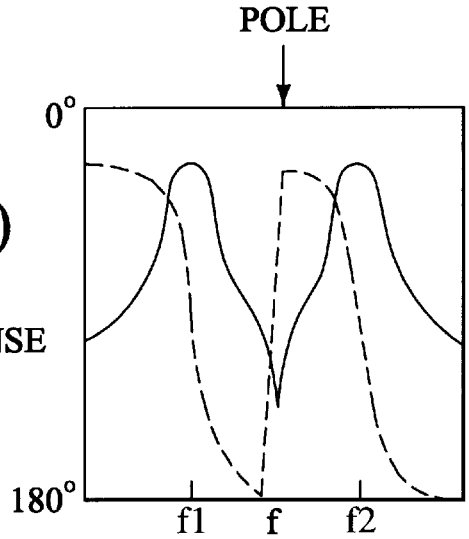
Figure 4A:
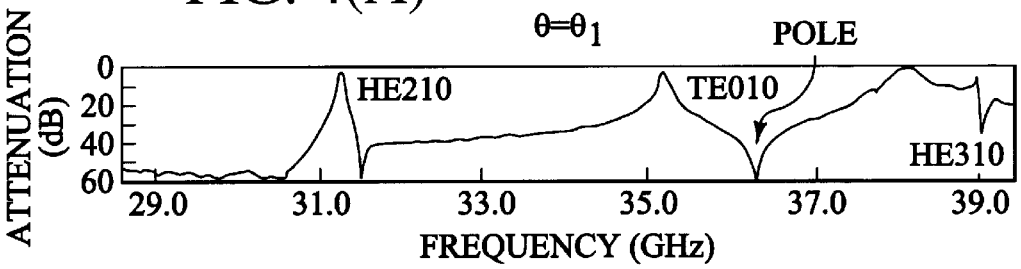
FIG. 4A to 4C are diagrams showing a change in an attenuation quantity when varying an angle formed by two coupling members.
Figure 4B:
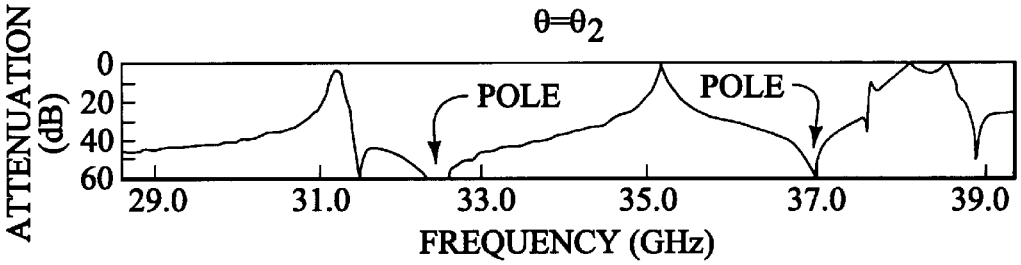
Figure 4C:
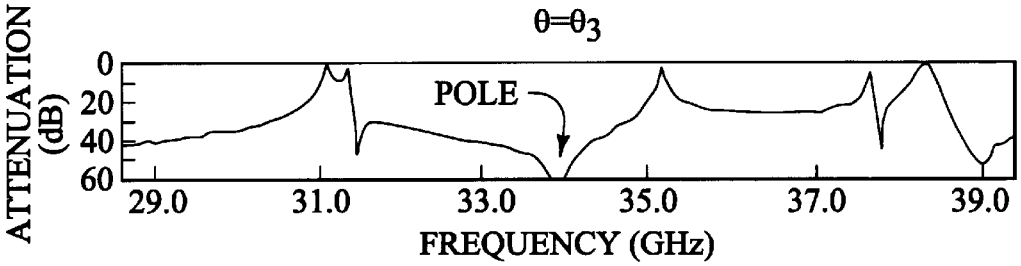
Figure 5:
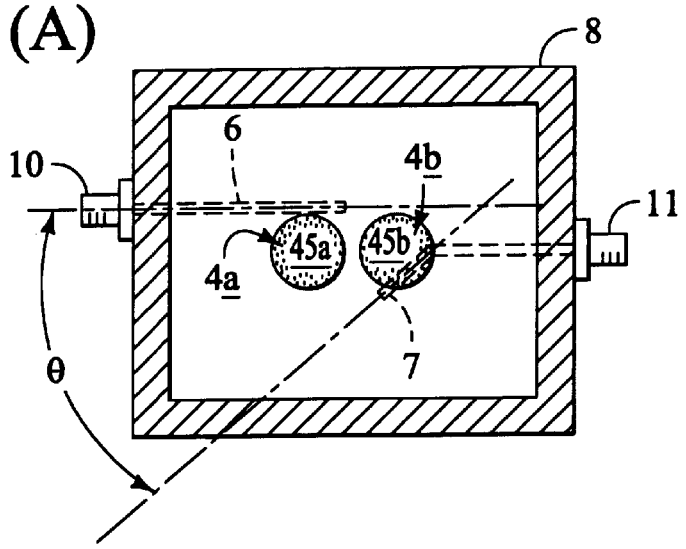
FIG. 5A to 5C are cross sectional views of each part of a dielectric filter according to a first embodiment of the present invention.
Figure 5:
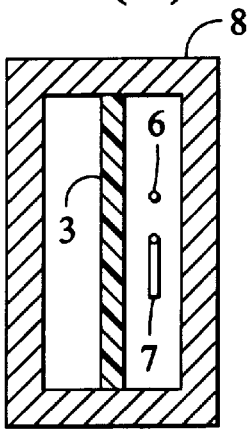
Figure 5:
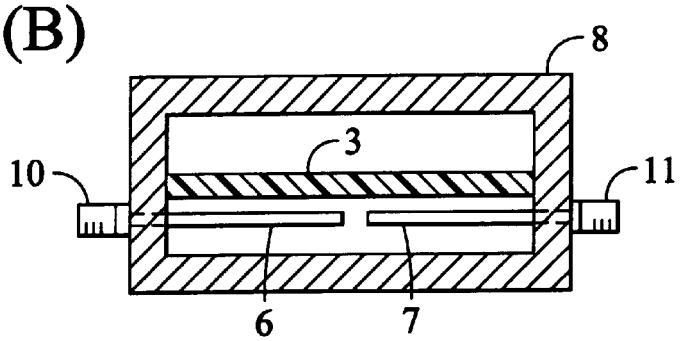

(A) of FIG. 5 is a cross sectional view at a plane parallel to a dielectric plate, (B) is a cross sectional view at a plane which is perpendicular to the dielectric plate and which is along an array direction of dielectric resonators, (C) is a cross sectional view at a plane which is perpendicular to the dielectric plate and which is perpendicular to an array direction of dielectric resonators. In the figures, a numeral 3 refers to the dielectric plate, and as shown in (A) forming an electrode as portions thereof being electrode non-formation parts 4*a*, 4*b*, on an upper surface thereof, and forming an electrode as portions opposite to the electrode non-formation parts 4*a*, 4*b* being electrode non-formation parts. As a result, forming two dielectric resonators 45*a*, 45*b*. The dielectric plate 3 is contained within a conductive case 8, and coaxial connectors 10, 11 are connected to two sides of the conductive case 8 which are opposite each other. Probes 6, 7 are respectively extruded from central conductors of these coaxial connectors 10, 11. The probe 6 is placed in parallel with array directions of two dielectric resonators, and a portion of the probe 7, which is close to the dielectric resonator 45*b* is bent so as to form a predetermined angle theta with respect to the probe 6.

With the above mentioned configuration, the probes 6, 7 are respectively magnetic-coupled with respect to the dielectric resonators 45*a*, 45*b*, and also the dielectric resonators 45*a* and 45*b* are magnetic-coupled. As a result, a dielectric filter having a band pass characteristic composed of resonators in two levels is constituted, between the coaxial connectors 10 and 11.

Figure 6:
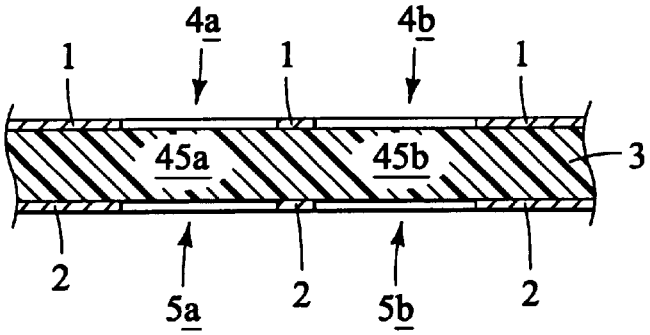
FIG. 6 is a cross sectional view of main parts of a dielectric plate of the dielectric filter shown in FIG. 5.

FIG. 6 is a cross sectional view at a dielectric resonator forming portion of a dielectric plate. As described above, constituting the dielectric resonator 45*a* in the opposite portions of the electrode non-formation parts 4*a* and 5*a*, and constituting the dielectric resonator 45*b* in the opposite portions of the electrode non-formation parts 4*b* and 5*b*, by forming the electrodes 1, 2 as the portions thereof being the electrode non-formation parts 4*a*, 4*b*, 5*a*, 5*b* on the upper and lower surfaces of the dielectric plate 3.

Figure 7A:
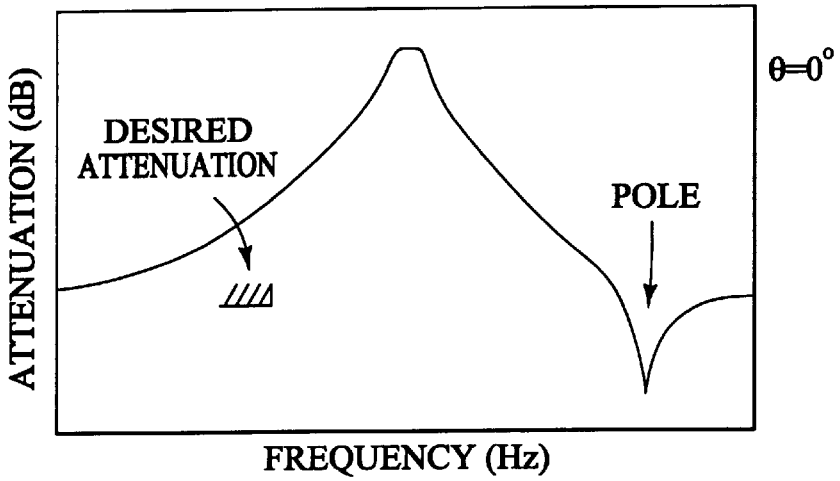
FIG. 7A to 7C are diagrams showing an attenuation characteristic of the dielectric filter shown in FIG. 5.
Figure 7B:
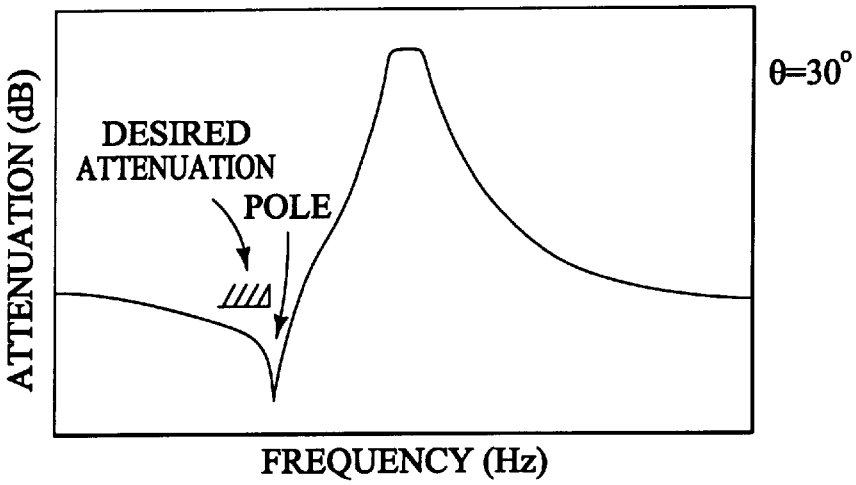
Figure 7C:
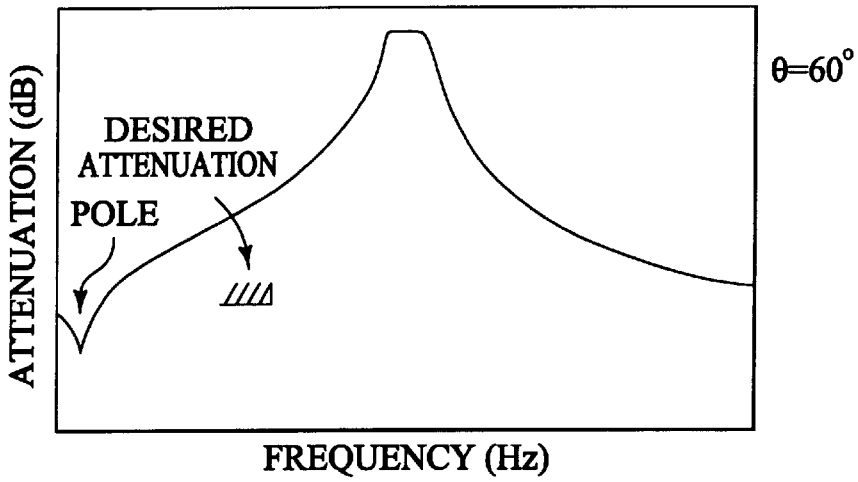

FIG. 7 shows the characteristics of the insertion losses for three examples of different angles theta shown in FIG. 5. In case of theta=0 degree as shown in (A) of FIG. 7, an attenuation pole is occurred at a high band side of a pass band by a combination of the responses of the $TE_{010}$ mode and the $HE_{310}$ mode. Further, in case of theta=30 degrees as shown in (B), an attenuation pole is occurred at a low band side of the pass band. Moreover, in case of theta=60 degrees as shown in (C), an attenuation pole is occurred at a position far apart at the low band side of the pass band. In a case that required attenuation specifications are a frequency and an attenuation quantity shown in the hatching, it needs to set the theta=30 degrees as shown in (B).

Figure 8:
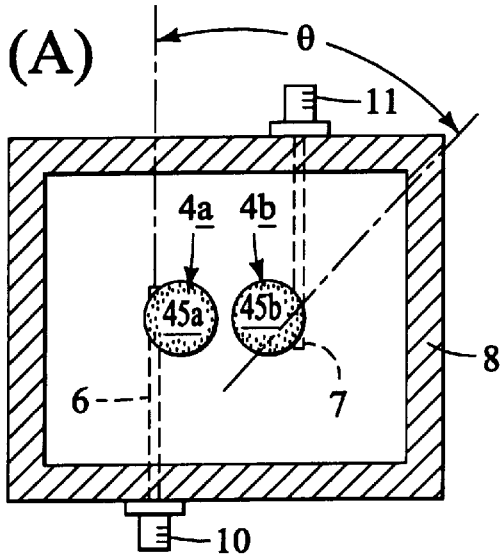
FIG. 8A to 8C are cross sectional views of each part of a dielectric filter according to a second embodiment of the present invention.
Figure 8:
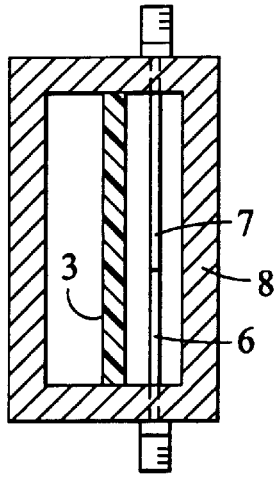
Figure 8:
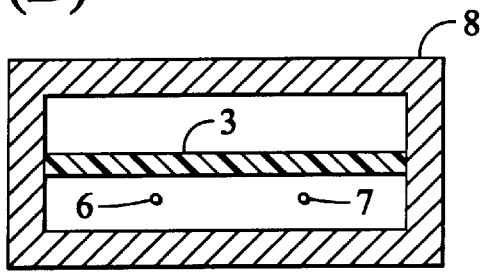

Next, a configuration of a dielectric filter according to a second embodiment will be described by referring to FIG. 8. As different from the one shown in FIG. 5, in this example, the directions of probes extended from the central conductors of the coaxial connectors 10, 11 made to be perpendicular to the array directions of the dielectric resonators. Other constitutions are the same as the ones shown in FIG. 5.

Figure 9:
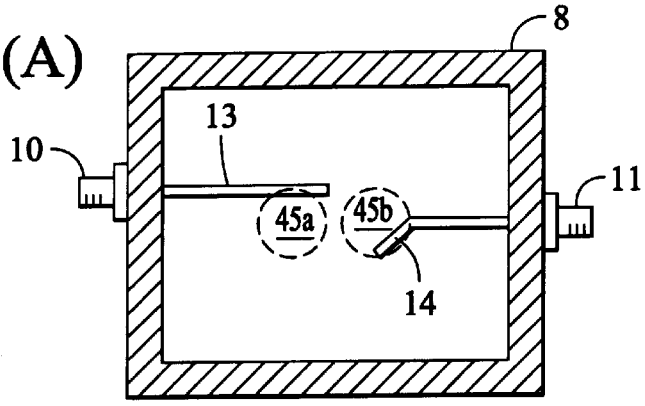
FIG. 9A to 9D are cross sectional views of each part of a dielectric filter according to a third embodiment of the present invention.
Figure 9:
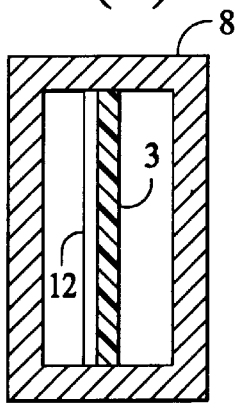
Figure 9:
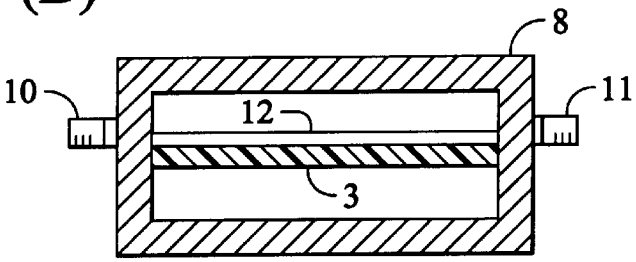
Figure 9:
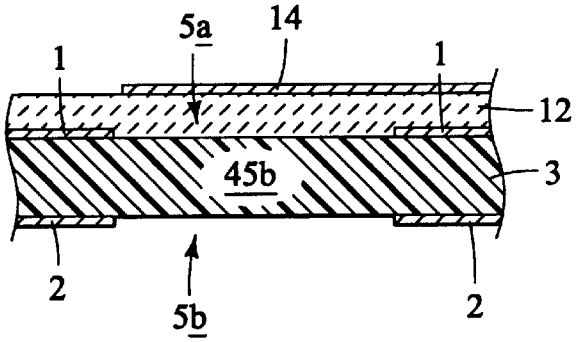

Then, a configuration of a dielectric filter according to a third embodiment will be described by referring to FIG. 9. In this third embodiment the microstrip lines are used as the coupling members. (A) in the figure is a cross sectional view at a plane parallel to the dielectric plate, (B) is a cross sectional view at a plane which is perpendicular to the dielectric plate and which is along with the array directions of the dielectric resonators, and (C) is a cross sectional view at a plane which is perpendicular to the dielectric plate and also perpendicular to the array directions of the dielectric resonators. (D) is a partial cross sectional view of the main parts thereof. In FIG. 9*a* numeral 12 refers to a dielectric sheet piled on the dielectric plate 3, and on an upper surface of this dielectric sheet the microstrip lines 13, 14 are formed as the coupling members. These microstrip lines use the electrode 1 on an upper surface of the dielectric plate 3 as a grounded conductor. Then the portions of these microstrip lines are magnetic-coupled by approaching to the dielectric resonators 45*a*, 45*b*, as shown in (A) and (D).

Figure 10:
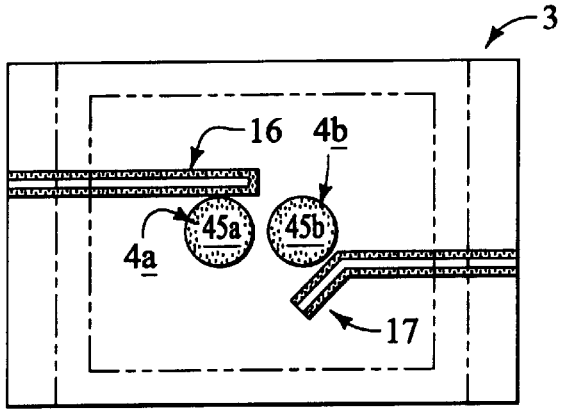
FIG. 10A and 10B are a plane view and a cross sectional view of a dielectric filter according to a fourth embodiment of the present invention.
Figure 10:
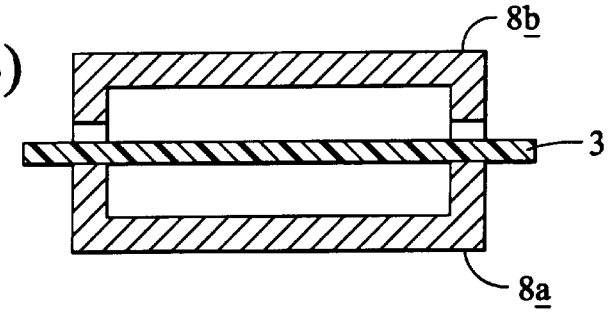

FIG. 10 is a diagram showing configuration of a dielectric filter according to a fourth embodiment. (A) is a plane view in a state of which a conductive case has been removed, (B) is a cross sectional diagram thereof. In FIG. 10, forming an electrode on an upper surface of the dielectric plate 3 as portions thereof being the electrode non-formation parts 4*a*, 4*b*, and forming an electrode on a lower surface as the opposite portions of the electrode non-formation parts 4*a* and 4*b* being the electrode non-formation parts thereof. Thereby two dielectric resonators 45*a*, 45*b* are provided. Further, on the upper surface of the dielectric plate 3, the coplanar lines indicated by 16, 17 are provided as the coupling members and the transmission lines of signals. In an example shown in the figure, a vicinity of a tip portion of the coplanar line 16 is magnetic-coupled with the dielectric resonator 45*a*, and a vicinity of a tip portion of the coplanar line 17 is magnetic-coupled with the dielectric resonator 45*b*. Then, a pattern of the coplanars is formed such that a direction of the coplanar line 16 and the tip portion of the coplanar line 17 make a predetermined angle.

In this fourth embodiment, not containing the dielectric plate within the conductive case, but by providing the conductive cases 8*a*, 8*b* with inserting the dielectric plate, the dielectric resonators and the coupling members to be coupled thereto are provided within the case thereof.

Figure 11:
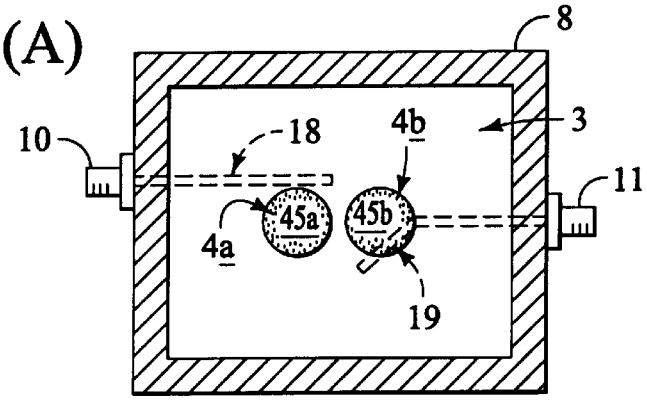
FIG. 11A and 11B are cross sectional views of a dielectric filter according to a fifth embodiment of the present invention.
Figure 11:
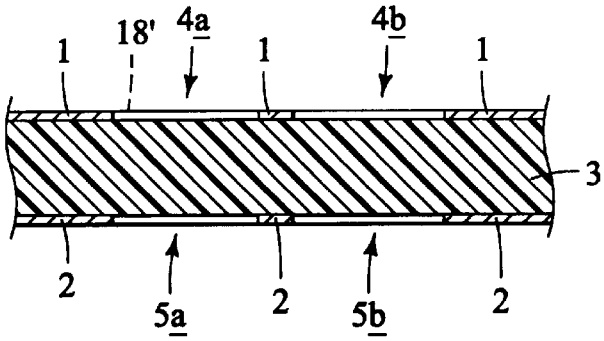

FIG. 11 is a diagram showing a configuration of a dielectric filter according to a fifth embodiment of the present invention. (A) is across sectional view at a plane parallel to the dielectric plate, (B) is a cross sectional view of the main parts of the dielectric plate. In this example the dielectric plate 3 forms a three-layers structure inserting a conductive layer between two dielectric layers, and two dielectric resonators 45*a*, 45*b* are constituted by forming the electrodes 1, 2 having the electrode non-formation parts 4*a*, 4*b*, 5*a*, 5*b*, on the outer surfaces of the dielectric plate 3. The strip lines 18, 19 with the electrodes 1, 2 as the grounded conductors are formed by providing a line conductor as indicated by 18' and another line conductor in an inner layer of the dielectric plate 3. The central conductors of the coaxial connectors 10, 11 are connected to the line conductors of the strip lines 18, 19 at the end surfaces of the dielectric plate 3. A vicinity of the tip portion of the strip line 18 is magnetic-coupled to the dielectric resonator 45*a*, and a vicinity of the tip portion of the strip line 19 is magnetic-coupled to the dielectric resonator 45*b*. The dielectric resonators 45*a* and 45*b* are also magnetic-coupled. As a result, a dielectric filter having a band pass characteristic having an attenuation pole in a predetermined frequency is formed between the coaxial connectors 10 and 11.

Figure 12:
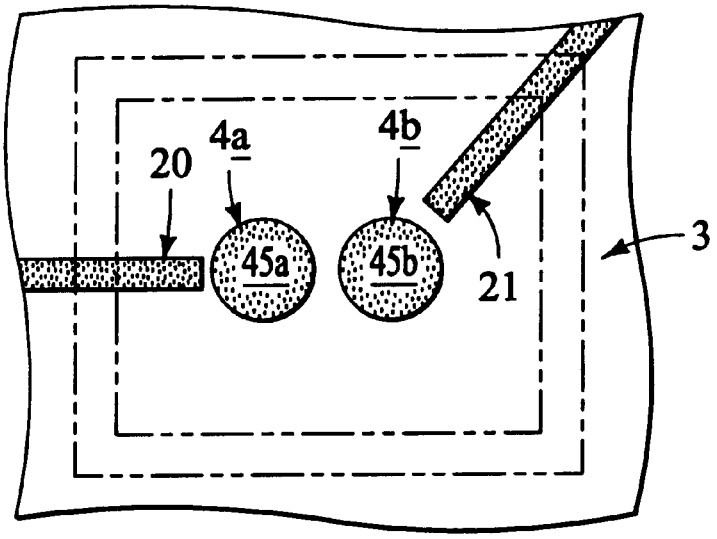
FIG. 12A and 12B are a partial plane view and a cross sectional view of a dielectric filter according to a sixth embodiment of the present invention.
Figure 12:
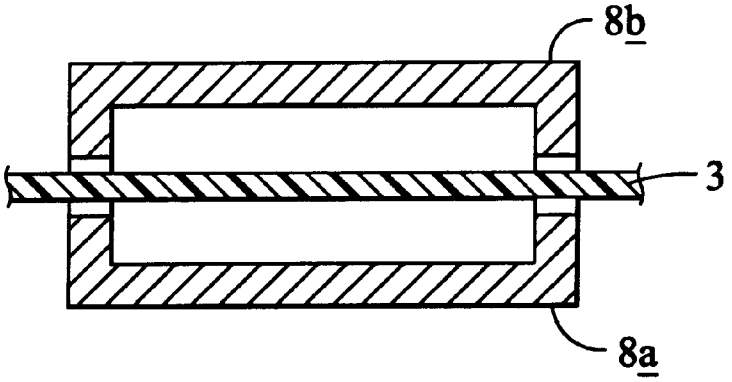

FIG. 12 is a diagram showing a configuration of a dielectric filter according to a sixth embodiment of the present invention. (A) is a partial plane view of the dielectric plate 3 in a state of the conductive case being removed, (B) is a cross sectional view at the conductive case installment part. On an upper surface of the dielectric plate 3, forming an electrode as portions thereof being the electrode non-formation parts 4*a*, 4*b*, and on a lower surface of the dielectric plate 3, forming an electrode as portions thereof opposite to the electrode non-formation parts 4*a*, 4*b* being the electrode non-formation parts. As a result, two dielectric resonators 45*a*, 45*b* are provided. Further on the upper surface of the dielectric plate 3, providing the electrode non-formation parts of the patterns indicated by 20, 21, and on the lower surface of the dielectric plate 3, providing the electrode non-formation parts in the portions opposite thereto, and providing 20, 21 as the coupling member and the slot line for a transmission line of a signal. In the example shown in the figure, the ends of the slot line are so placed as to be opposite to the dielectric resonators. As a result, a signal transmits the slot lines in the TE mode, and the slot lines 20, 21 are respectively magnetic-coupled to the dielectric resonators 45*a*, 45*b*. Then, the patterns thereof is so formed that these slot lines 20 and 21 make a predetermined angle.

Figure 13:
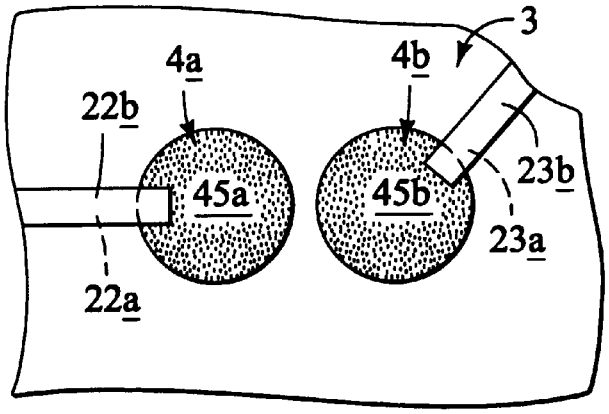
FIG. 13A and 13B are a partial plane view and a cross sectional view of a dielectric filter according to a seventh embodiment of the present invention.
Figure 13:
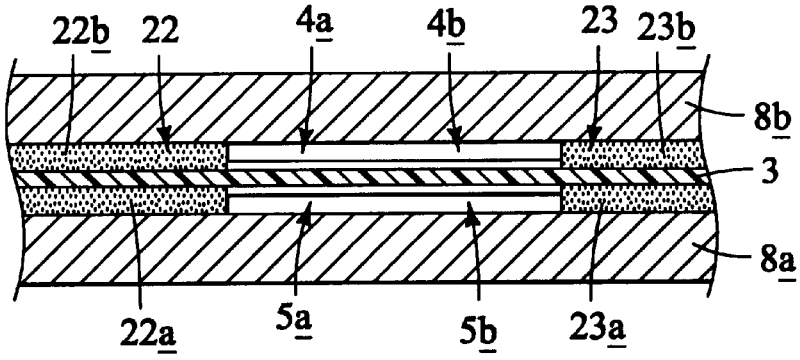

FIG. 13 is a diagram showing a configuration of a dielectric filter according to a seventh embodiment of the present invention. (A) is a partial plane view in a state of a conductive case being removed, (B) is a cross sectional view of the main parts thereof. A configuration of the dielectric plate 3 is the same as the ones shown in FIGS. 8 and 9. In FIG. 13, numerals 22*a*, 22*b*, 23*a*, and 23*b* respectively refer to dielectric strips, and are placed, by inserting the dielectric plates 3, on the upper and lower portions thereof, and further the conductive cases 8*a*, 8*b* are placed the outsides thereof. As a result, the portions indicated by 22, 23 are configured as non-radiational dielectric lines (NRD guides). With this configuration, signals propagate through the dielectric lines in the LSM mode, and magnetic-coupled to the dielectric resonators 45*a*, 45*b*, respectively. By the way, in case of making an electric field-coupling, it needs to change a placement relation of the dielectric resonators and the dielectric strips, such that the dielectric resonators are placed in the side portions of the dielectric strips.

Figure 14:
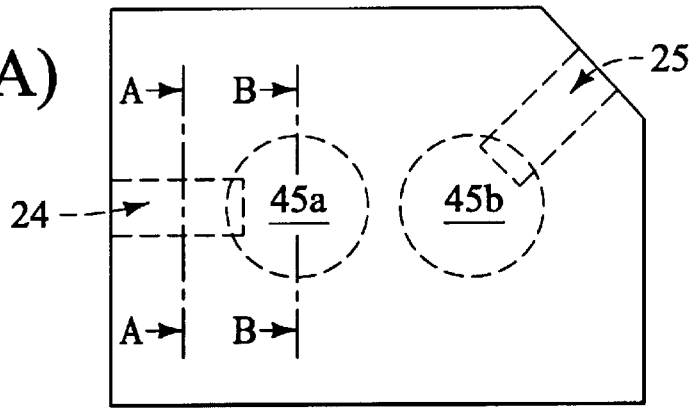
FIG. 14A to 14C are a partial plane view and a cross sectional view of a dielectric filter according to an eighth embodiment of the present invention.
Figure 14:
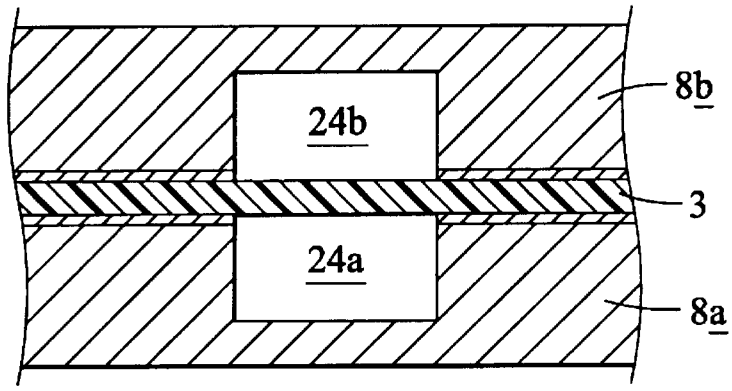
Figure 14:
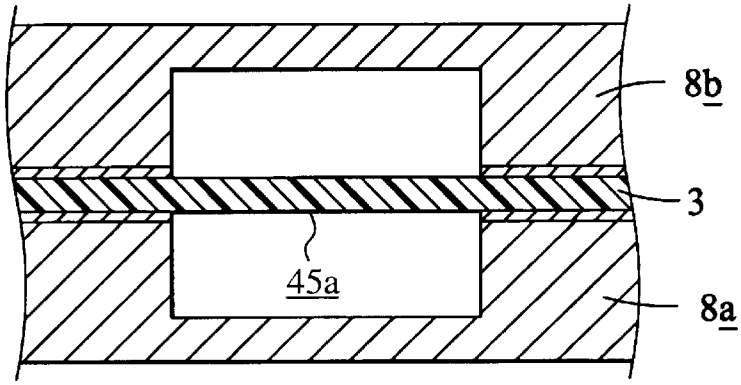

FIG. 14 is a diagram showing a configuration of a dielectric filter according to an eighth embodiment of the present invention. (A) is a plane view thereof, (B) is a cross sectional view of the A—A portion in (A), and (C) is a cross sectional view of the B—B portion in (A). A configuration of the dielectric plate 3 is the same as the one shown in FIGS. 8 and 9. By providing the hollows inside of the conductive cases 8*a*, 8*b* such as this, 24*a*, 24*b* shown in (B) are used as waveguides. Further, the spaces are formed in the upper and lower portions of the dielectric resonators as shown in (C). As a result, constituting the dielectric resonators on the dielectric plate as well as obtaining the dielectric filter with the waveguides as the transmission lines.

Meantime, in each embodiment described above, it is arranged as the dielectric filter composed of two-levels resonators by forming two dielectric resonators and then by coupling both of them, but it is apparent that a number of levels of the resonators may be equal to or greater than two.

Next, the embodiments of an antenna common use device and a communication device will be described by referring to FIG. 15.

Figure 15:
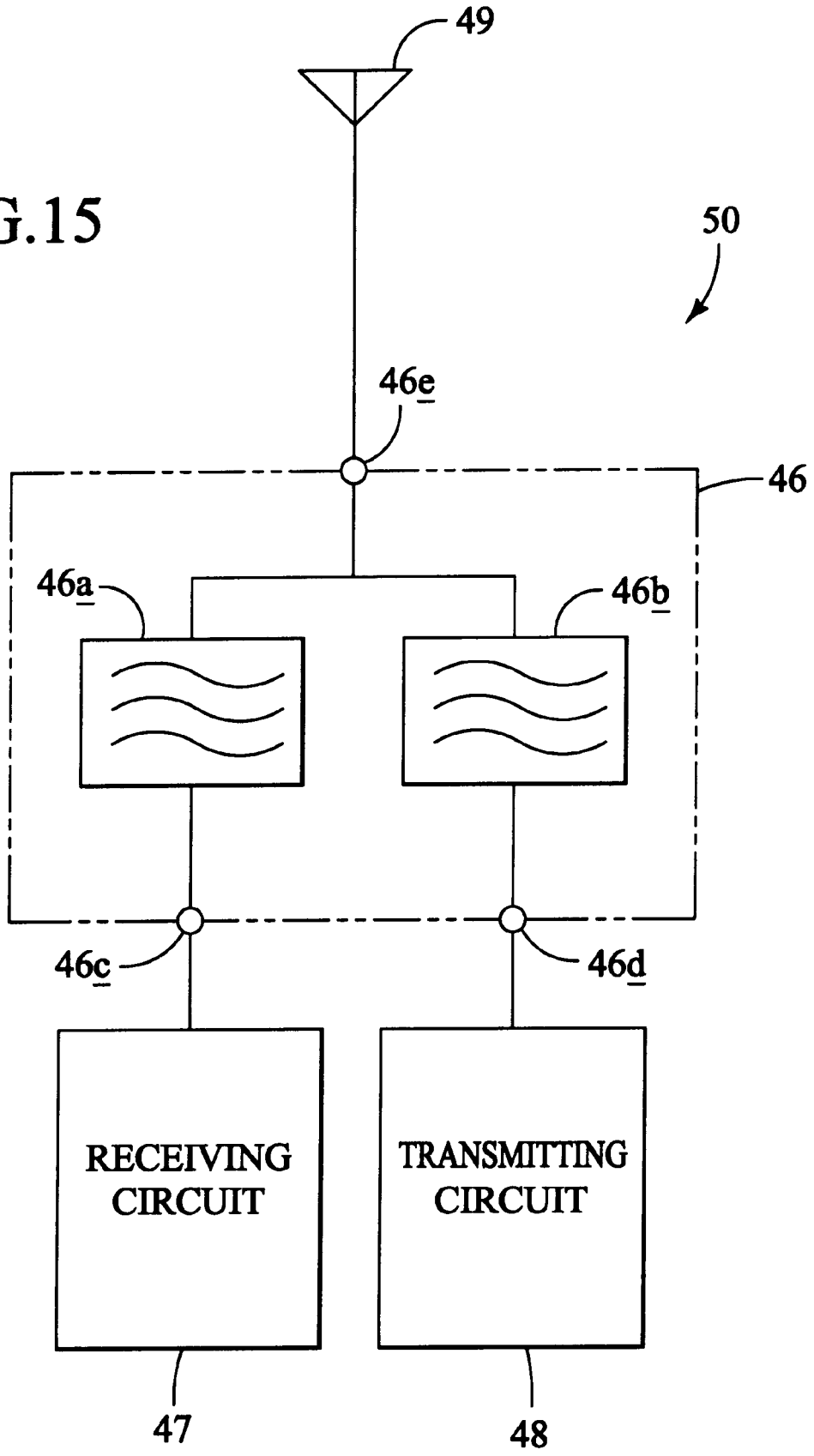
FIG. 15 is a block diagram showing a configuration of a communication device according to a ninth embodiment of the present invention.

FIG. 15 is a block diagram showing a configuration of the communication device. In the figure, a numeral 46 refers to the antenna common use device of which a numeral 46*c* refers to a receiving signal output port, a numeral 46*d* refers to a transmitting signal input port, a numeral 46*e* refers to an antenna port, and corresponds to the transmitter-receiver common use device according to the present invention. A receiving filter 46*a* is provided between the receiving signal output port 46*c* and the antenna port 46*e* of this antenna common use device 46, and a transmitting filter 46*b* is provided between the transmitting signal input port 46*d* and the antenna port 46*e*, respectively.

Any of the configurations of dielectric filters shown in the first to eighth embodiments is used as the receiving filter 46*a* and the transmitting filter 46*b*. The dielectric resonators of these receiving filter and the transmitting filter may be formed on the same dielectric plate, or may be formed on separate dielectric plates, respectively. Further, in case of a configuration by extruding the probes from the central conductors of the coaxial connectors as shown in FIG. 5, and connecting these probes to the dielectric resonators formed on the dielectric plate, it is needed to form the receiving filter and the transmitting filter on the dielectric plate, respectively, making the receiving signal output port 46*c* and the transmitting signal input port 46*d* as the coaxial connectors, respectively, extruding the probe from the central conductor of the coaxial connector as the receiving signal output port 46*c*, coupling with the dielectric resonator in the output level (the last level) of the receiving filter, extruding the probe from the central conductor of the coaxial connector as the transmitting signal input port 46*d*, and then coupling with the dielectric resonator in the input level (the first level) of the receiving filter. Further, it is needed to provide a conductor having a predetermined line length for use in phase control between a probe coupled to the input level (the first level) of the receiving filter 46*a* and a probe coupled to the output level (the last level) of the transmitting filter 46*b*, and then connecting the central conductor of the coaxial connector as the antenna port 46*e* to that conductor. For example, it is branched out at a point which turns to be a relation of an odd number multiple of ¼ wavelength respectively with wavelengths on the lines in the transmitting frequency and the receiving frequency, from the respective equivalent short surfaces of the receiving filter and the receiving filter which are the band pass filters. As a result, an impedance which is seen as the receiving filter with a wavelength of the transmitting frequency, and an impedance which is seen as the transmitting filter with a wavelength of the receiving frequency turn to be very large, respectively, thereby branching of the transmitting signals and the receiving signals would be made.

As described above, by using the dielectric filter of the present invention in place of the receiving filter and the transmitting filter of the antenna common use device, it is possible to attenuate the transmitting frequency band in the receiving filter and the receiving frequency band in the transmitting filter, in large quantities, respectively. Also, since it enables to secure a predetermined attenuation quantity in a predetermined frequency band, by the dielectric resonators with less levels, the antenna common use device can be miniaturized.

Moreover, only either one of the receiving filter or the transmitting filter may adopt any configuration of the dielectric filters described in the first to the eighth embodiments as required. Further, although the antenna common use device is shown in this embodiment, generally the present invention can be adapted to a transmitter-receiver common device which is arranged to connect a transmission line to a port for use in an input/output of a signal, instead of connecting the antenna thereto.

In the example shown in FIG. 15, by connecting a receiving circuit 47 to a receiving signal output port 46*c*, and a transmitting circuit 48 to a transmitting signal input port 46*d* of the antenna common use device 46, respectively, and by connecting the antenna 49 to the antenna port 46*e*, the communication device 50 is constituted as a whole. This communication device, for example, constitutes a radio frequency circuit portion of a portable telephone and the like.

As described above, by using the antenna common use device which adopts the dielectric filter of the present invention, a miniature communication device using a miniature antenna common use device can be constituted.

According to the present invention, two coupling members couple to a plurality of resonance modes of the dielectric resonators, and the attenuation pole is occurred by a combination of the responses for these resonance modes, thereby the attenuation quantity near its attenuation pole can be gained with great quantity. Accordingly, in the block band attenuation characteristic, even in a case that the requirement of the attenuation quantity required at a certain frequency is much severe than the conventional one, its requirement can be satisfied. Particularly in an inter-level filter, an oscillation frequency and an image frequency of the local oscillator can be attenuated with great quantities, and also in the antenna common device, an attenuation quantity of the receiving band in the transmitting side filter, and an attenuation quantity of the transmitting band in the receiving side filter can be much more increased.

In particular according to the invention described in the claim 2, a connection of the probe which is the coupling member and the coaxial connector will be facilitated.

Further, according to the inventions, since the coupling members and the microstrip lines or the strip lines as the transmission lines are constituted laminate apart from the dielectric plate, an overall area can be scaled-down.

Moreover, according to the inventions, since the coupling members can be constituted as a single-piece into the dielectric plate, an overall number of parts can be reduced.

According to the inventions, together with the dielectric plate constituting the dielectric resonator, it turns to constitute the dielectric lines or the waveguides as the coupling members and the transmission lines, a module which uses the dielectric resonators and the dielectric lines or the waveguides can be easily constituted.

Further, according to the invention, even though a number of the levels of the dielectric resonators are small, since the predetermined attenuation quantities can be secured to the transmitting frequency band in the receiving filter, and to the receiving frequency band in the transmitting filter, respectively, it can be miniaturized as a whole According to the invention described, by using a miniaturized transmitter-receiver common use device, a communication device can be miniaturized as a whole.

What is claimed is:

1. A dielectric filter, comprising:

a dielectric plate;

an electrode on a first main surface of said dielectric plate with a first opening defined therein;

an electrode on a second main surface of said dielectric plate with a second opening defined therein which is opposite to said first opening of said first main surface, said first and second openings and said dielectric plate therebetween forming a dielectric resonator; and two coupling members coupled to said dielectric resonator;

wherein said two coupling members are non-parallel to each other and one of said coupling members is coupled with at least two coupling modes of said resonator.

2. A dielectric filter according to claim 1, wherein each of said two coupling members comprises a respective probe, and an angle of said two coupling members is defined by a bend in one said probe.

3. A dielectric filter according to claim 1, wherein said coupling members comprise respective microstrip lines associated with said dielectric plate.

4. A dielectric filter according to claim 1, wherein each said coupling member comprises a coplanar guide associated with said dielectric plate.

5. A dielectric filter according to claim 1, wherein said dielectric plate has multiple layers, and each said coupling member comprises a strip line formed by providing a line conductor on an inner layer of said dielectric plate.

6. A dielectric filter according to claim 1, wherein each said coupling member comprises a dielectric line associated with said dielectric plate.

7. A dielectric filter according to claim 1, wherein each said coupling member comprises a wave guide associated with said dielectric plate.

8. A dielectric filter according to claim 1, wherein each said coupling member comprises a slot line associated with said dielectric plate.

9. A dielectric filter according to claim 1, wherein said at least two coupling modes include at least the $TE_{010}$ and $HE_{210}$ modes.

10. A duplexer comprising:

a receiving filter;

a transmitting filter;

an input/output port being connected to both of said filters;

an input port being connected to said transmitting filter;

an output port being connected to said receiving filter;

wherein one of said filters includes the filter according to claim 1.

11. A communication device comprising:

a duplexer according to claim 10;

a receiving circuit being connected to said output port;

a transmitting circuit being connected to said input port.

12. A communication device according to claim 11, further comprising an antenna connected to said input/output port of the duplexer.

* * * * *